US011725877B2

(12) United States Patent
Dalmolin

(10) Patent No.: US 11,725,877 B2
(45) Date of Patent: Aug. 15, 2023

(54) SYSTEM, METHOD, AND APPARATUS FOR MONITORING REFRIGERATION UNITS

(71) Applicant: Guido Dalmolin, Clermont, FL (US)

(72) Inventor: Guido Dalmolin, Clermont, FL (US)

( * ) Notice: Subject to any disclaimer, the term of this patent is extended or adjusted under 35 U.S.C. 154(b) by 143 days.

(21) Appl. No.: 17/214,977

(22) Filed: Mar. 29, 2021

(65) Prior Publication Data

US 2021/0215419 A1 Jul. 15, 2021

Related U.S. Application Data

(63) Continuation-in-part of application No. 16/827,803, filed on Mar. 24, 2020, now Pat. No. 10,989,464, which is a continuation-in-part of application No. 15/782,852, filed on Oct. 13, 2017, now Pat. No. 10,641,532.

(60) Provisional application No. 62/535,138, filed on Jul. 20, 2017.

(51) Int. Cl.

| | |
|---|---|
| ***F25B 49/02*** | (2006.01) |
| ***F25D 29/00*** | (2006.01) |
| ***F25D 3/00*** | (2006.01) |

(52) U.S. Cl.

CPC ..... *F25D 29/006* (2013.01); *F25D 3/00* (2013.01); *F25D 2303/085* (2013.01); *F25D 2700/12* (2013.01)

(58) Field of Classification Search

CPC .... F25D 29/006; F25D 3/00; F25D 2303/085; F25D 2700/12; F25D 2700/02; F25B 49/005

See application file for complete search history.

(56) References Cited

U.S. PATENT DOCUMENTS

| | | | | |
|---|---|---|---|---|
| 5,533,349 | A | 7/1996 | Gromala | |
| 6,927,871 | B1 | 8/2005 | Silverbrook | |
| 7,150,156 | B2 | 12/2006 | Gatling | |
| 7,728,711 | B2 | 6/2010 | Shoenfeld | |
| 9,513,043 | B2 | 12/2016 | Keres | |
| 9,846,086 | B1 * | 12/2017 | Robinson | G01K 3/04 |
| 10,641,532 | B2 | 5/2020 | Dalmolin | |
| 10,677,484 | B2 | 6/2020 | Ribbich et al. | |
| 2015/0268281 | A1 | 9/2015 | Haghighat-Kashani | |
| 2016/0283086 | A1 * | 9/2016 | Inagaki | G06F 1/1643 |
| 2018/0058739 | A1 * | 3/2018 | Zou | F25B 49/00 |

* cited by examiner

*Primary Examiner* — Elias Desta

(74) *Attorney, Agent, or Firm* — Larson & Larson, P.A.; Frank Liebenow; Justin P. Miller

(57) ABSTRACT

A system for monitoring and reporting internal refrigeration unit temperatures includes a temperature measuring device for placement within the refrigeration unit. The temperature measuring device has a first temperature sensors situated in a liquid or solid mass (e.g. glycol or glass beads) for measuring an average temperature within the refrigeration unit and/or has a second temperature sensors exposed to ambient air within the refrigeration unit for measuring an instantaneous temperature within the refrigeration unit. A circuit periodically transmits the average temperature and/or the instantaneous temperature from the temperature measuring device to a server where the average temperature and the instantaneous temperature are analyzed to determine and/or predict a fault with the refrigeration unit. Upon determination and/or prediction of the fault, an alert is sent to at least one staff member indicating the refrigeration unit and fault.

10 Claims, 11 Drawing Sheets

SYSTEM, METHOD, AND APPARATUS FOR MONITORING REFRIGERATION UNITS

CROSS-REFERENCE TO RELATED APPLICATION

This application is a continuation-in-part of U.S. patent application Ser. No. 16/827,803 filed on Mar. 24, 2020, which is a continuation-in-part of U.S. patent application Ser. No. 15/782,852 filed on Oct. 13, 2017, now U.S. patent Ser. No. 10/641,532 issued May 20, 2020, which claims the benefit of U.S. provisional application No. 62/535,138 filed on Jul. 20, 2017, the disclosure of which are incorporated by reference.

FIELD

This invention relates to temperature monitoring and more particularly to a system for monitoring temperatures in refrigeration units, especially those used to store medications.

BACKGROUND

Federal programs such as the Vaccines for Children (VFC) program provide federally-funded vaccines to private pediatric practices via state agencies. The state agencies are responsible for collecting and monitoring temperature data provided by the private pediatric personnel.

Until recently, the data was often written down twice daily by office personnel and reviewed periodically by state health inspectors when they made routine inspection visits to the practice.

Very recently there has been an increasing awareness that these drugs are not being monitored sufficiently. There is a strong sense of urgency to ensure the drugs are still effective at the time they are administered to patients.

Several states are attempting to find better solutions address these problems. One State, in particular, has provided temperature logging devices to all the VFC pediatric practices within that State. The devices are attached to the refrigerators that contain the VFC vaccines and require the health care providers to remove the devices from the refrigerators on a weekly basis and connect them to USB docking stations attached to their office computers. Upon connection, the devices generate plain text files consisting of temperature and time data structured as columns delimited by commas or Comma Separated Value (CSV) files. These plain text files are then uploaded to the state VFC database. There are several obvious problems with this method. The CSV file can be manipulated prior to uploading to state or federal agencies and it is a never-ending tedious cycle that places additional burdens on office personnel. Additionally, the temperature is not being monitored for the duration of data acquisition using USB docking station and no data is available in the intervals between device docking. Thus, the data only identifies temperature problems several days after they have already occurred. If a problem is detected, the pediatric practice is financially responsible for replacing the entire stock of vaccines and drugs. A typical home-style refrigerator can easily store several hundred thousand dollars' worth of vaccines.

A mandate requiring continuous and automatic temperature monitoring with alarm reporting capabilities is inevitable. However, even before this mandate becomes effective, doctors and state officials are searching for reliable solutions to protect vaccines from damage due to poor temperature conditions. In order to enforce the safety procedures, officials must obtain uncompromised temperature data and not rely on data that can be manipulated or destroyed by the health care providers. In order for health care providers to respond to temperature problems before damage occurs, they must receive alert notifications and physically respond in a timely manner. Because life, health, and great financial costs are at risk, a secure audit trail of all temperature data, alert notifications, alert acknowledgements, and physical response confirmations is critical to ensure optimum safety and accountability. In some embodiments, a temperature graph is presented to staff before the staff acknowledges and/or signs a temperature inspection report. It forces them to view useful data and not a single numeric temperature which represents only a single moment in time During the normal operation of typical home-style refrigerators air temperatures fluctuate greatly when the compressors cycle on and off. Additionally, the air temperatures also fluctuate greatly when the doors are opened and closed. Because the process of monitoring temperature data by officials (and the logging of the data itself) was previously a manual hands-on process, it was very difficult to analyze this data in a manner that would indicate the true average temperature of the refrigerator and ultimately the vaccines.

For this reason, federal guidelines require that the temperature measuring devices are placed in a buffered solution such as propylene glycol. A bottle of glycol increases the physical mass of the temperature sensor and ultimately slows down the response time providing a flatter, more stable temperature reading.

The obvious drawback of this method is a delayed detection of a genuine refrigeration system problem as the material will retain certain amounts of heat/cold for a period of time after refrigeration failure.

In addition to these temperature-detection shortcomings, all temperature alarm systems known to date simply send unconfirmed alert messages via SMS, email, or voice calls. No system known to date provides operator accountability by acknowledging that the alert messages are actually received by the intended recipient.

Furthermore, even if the recipient is known to have received the alert message, no system known to date confirms that a physical response procedure has been performed in a timely manner.

Other systems typically use the health-care provider's internet connectivity and will not operate when the internet or utilities fail. Some systems are cellular-only but none known to date operates in dual mode, using the provider's internet as a primary source, but only reverting to cellular when the primary connection fails.

Prior systems required a wire connection, providing power and transferring temperature data. As refrigeration units are sealed for thermal insulation, it is often difficult to properly run such wires and these wires are often strung across seal areas of door, resulting in leaks and reduced efficiency. When a battery-operated wireless system is implemented, the battery life becomes an issue and battery management must be performed.

What is needed is a system that will monitor temperatures within refrigeration units and provide reporting, alerts, and predictive analysis.

SUMMARY

The system for monitoring and reporting internal refrigeration unit temperatures periodically transmits any or all of a buffered temperature within the refrigeration unit, an ambient temperature within the refrigeration unit, a light level within the refrigeration unit, a battery status, an identification value, and a tamper indication. The system for monitoring and reporting includes a receiver device that receives the above and monitors adherence to required temperature ranges as well as tracking historical values to predict refrigeration unit failure or detect unwanted situations such as when a door is inadvertently left ajar.

In one embodiment, a system and method to record and distribute temperature information that is collected from a temperature monitoring device is disclosed. The temperature monitoring device is designed to be placed directly inside refrigerators and freezers and provides real-time temperature and optionally lighting levels that are transmitted to a server. The server alerts when one or more temperature or refrigeration system events occur. These events include temperatures that either exceed or fall below pre-set warning or limit values, or when temperature trends are symptomatic of underlying refrigeration system faults are detected.

In one embodiment, a system for monitoring and reporting internal refrigeration unit temperatures includes a temperature measuring device for placement within a refrigeration unit. The temperature measuring device is housed within an enclosure and has a first temperature sensor situated in a solid or liquid mass that measures a buffered temperature within the refrigeration unit and has a second temperature sensor interfaced to ambient air within the refrigeration unit that measures an instantaneous temperature within the refrigeration unit. A transmitter is located within the refrigeration unit and operatively coupled to the first temperature sensor and the second temperature sensor. The transmitter periodically transmits the buffered temperature and the instantaneous temperature from the temperature measuring device. A receiver device (external to the refrigeration unit) receives the buffered temperature and the instantaneous temperature and analyzes and records the buffered temperature and the instantaneous temperature. The temperature measuring device is powered by a rechargeable battery and the rechargeable battery is wirelessly recharged In another embodiment, a system for reporting internal refrigeration unit temperatures includes a first temperature sensor situated in a solid or liquid mass for measuring a buffered temperature within a refrigeration unit and a second temperature sensor exposed to ambient air within the refrigeration unit for measuring an instantaneous temperature within the refrigeration unit. A transmitter is operatively coupled to the first temperature sensor and to the second temperature sensor; the transmitter periodically transmitting the buffered temperature and the instantaneous temperature (e.g., to a receiving device). A rechargeable battery is operatively coupled to and provides electrical power to the transmitter and a wireless charge receiver is coupled to the rechargeable battery. The wireless charge receiver receives power wirelessly and provides electrical current to the rechargeable battery for recharging the rechargeable battery.

In another embodiment, a method for monitoring temperatures in a refrigeration unit includes receiving a buffered temperature from a first temperature sensor located in a solid or liquid mass within the refrigeration unit and receiving an instantaneous temperature from a second temperature sensor that measures ambient air temperature within the refrigeration unit. The buffered temperature and the instantaneous temperature are wirelessly transmitted for reception outside of the refrigeration unit. Power for the step of transmitting is provided from a rechargeable battery and recharge power is provided to the rechargeable battery from a wireless charging circuit which receives the recharge power from a wireless charge transmitter that is in proximity to the wireless charging circuit.

The system for temperature monitoring and alerting recognizes fault and trending conditions and provides real-time alert messages, confirmation of message receipt, and acknowledgements. The system for temperature monitoring and alerting also confirms that a physical on-site response has been performed. In some embodiments, failure to acknowledge an alert message or physically respond to the alert location in a timely manner results in a hierarchy of alert message escalations to additional personnel and management.

The system for temperature monitoring and alerting not only provides real-time glycol-based buffered temperature data required for regulatory agencies, but also monitors the air temperature within the refrigerator and/or freezers. Software running on a server processes the data received from the temperature measuring device and detects the normal on-off cycling of the refrigerators' compressors. Deviations from the "normal" on-off cycle pattern generate an alert message indicating that the compressors have either failed or are operating outside normal parameters. This failure detection solution provides a much faster detection of potential temperature problems as it detects when the compressor stops functioning instead of waiting for lagging indicators such as glycol-based or air temperatures to rise to critical levels, allowing for application of ice packs to preserve contents of the units.

In some embodiments, especially those in which there are no regulatory requirements for glycol-based buffered temperature data, the buffered temperature is calculated by averaging the ambient temperature within the refrigeration unit over time.

In some embodiments, the buffered temperature data (e.g. temperature measurement sensed/taken within a mass of material such as glycol or glass beads) is used to monitor the on/off cycles of the refrigeration unit over time and is used to predict failures and/or doors left open.

A significant rate-of-rise in temperature between normal compressor cycles is an indication that either a refrigeration unit door was opened, or that the refrigeration unit is in a defrost cycle. The significant rate-of-rise can serve to delay the alert messages for a specified period of time to allow for the normal compressor cycle pattern to resume.

In some embodiments, an ambient light sensor is used to detect when refrigerator and freezer doors are open. Software running on the server records such and temporarily allows irregular temperature patterns to occur during such operation without generating an alert.

In some embodiments, if light is detected for prolonged periods of time (specified by the user), the server generates alert messages indicating that a door has been left open.

In one embodiment, a system for monitoring and reporting internal refrigeration unit temperatures includes a temperature measuring device for placement within the refrigeration unit. The temperature measuring device has a first temperature sensor situated in a buffer (e.g., a solid or liquid mass) for measuring a buffered temperature (e.g., an average temperature) within the refrigeration unit and has a second temperature sensor exposed to ambient air within the refrigeration unit for measuring an instantaneous temperature within the refrigeration unit. A circuit periodically transmits the buffered temperature and the instantaneous temperature from the temperature measuring device to a server where the buffered temperature and the instantaneous temperature are analyzed to determine and/or predict a fault with the refrigeration unit. Upon determination and/or prediction of the fault, sending an alert is sent to at least one staff member indicating the refrigeration unit and fault.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
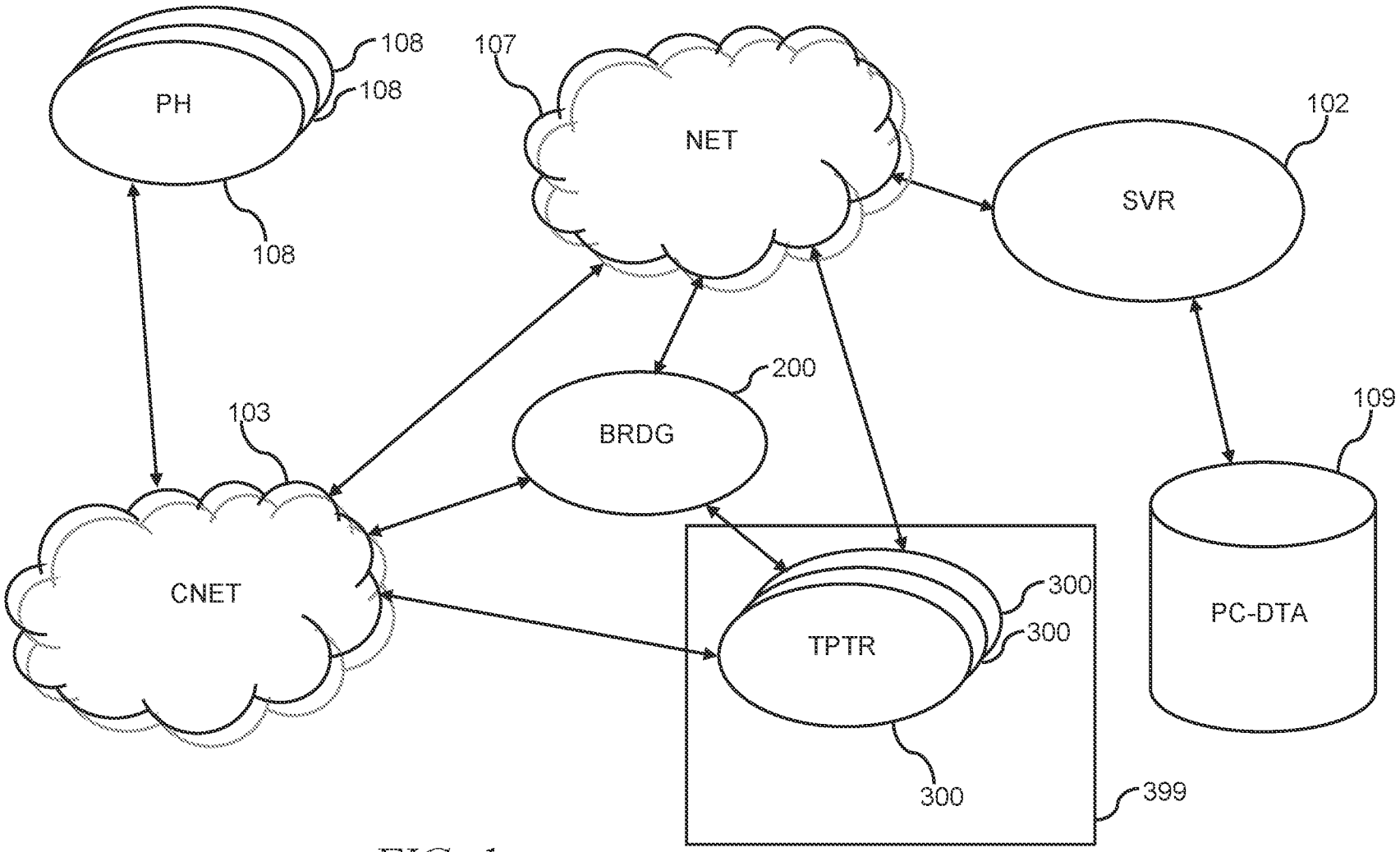
FIG. 1 illustrates a data connection diagram of the system for temperature monitoring and alerting.

Reference will now be made in detail to the presently preferred embodiments of the invention, examples of which are illustrated in the accompanying drawings. Throughout the following detailed description, the same reference numerals refer to the same elements in all figures.

In general, the system for temperature monitoring and alerting provides capabilities to measure temperatures and optionally light levels within a refrigeration unit, reporting such temperatures for various purposes such as recordation to comply with local/federal requirements for the storage of vaccines, etc. The system for temperature monitoring and alerting differentiates between a door remaining open (fast rise in temperature) and a failing compressor or power failure (slow rise in temperature), and reports such in alerts.

Referring to FIG. 1 illustrates a data connection diagram of the system for temperature monitoring and alerting. In this example, one or more remote devices such as cell phones 108 communicate through the cellular network 103 and/or through a wide area network 107 (e.g. the Internet) to a server computer 102.

The server computer 102 that is external to the refrigeration unit 399 has access to data storage 109 for storing various data, including historical temperature readings, etc. Although one path between the remote devices or cell phones 108 and the server computer 102 is through the cellular network 103 and the wide area network 107 as shown, any known data path is anticipated. For example, the Wi-Fi transceiver 96 (see FIG. 2) of the remote devices or cell phone 108 is used to communicate directly with the wide area network 107, which includes the Internet, and, consequently, with the server computer 102.

The server computer 102 transacts with the remote devices or cell phones 108 through the network(s) 103/107 to present menus to/on the remote devices or cell phones 108, provide data to the remote devices or cell phones 108, and to communicate information such as alerts to the remote devices or cell phones 108.

The server computer 102 transacts with applications running on the remote devices or cell phones 108 and/or with standardized applications (e.g., browsers) running on the user's remote devices or cell phones 108.

The system for temperature monitoring and alerting includes at least one temperature measuring device 300 located within the refrigeration unit 399. The temperature measuring devices 300 are battery-powered and include a transmitter 300*e* that transmit messages to either a bridge unit 200 that is external to the refrigeration unit 399 or directly to the server computer 102 that is also external to the refrigeration unit 399 through a wireless local area network or through the cellular network 103, in some embodiments through encrypted RF transmissions. As power consumption of the temperature measuring devices 300 is important, less power is required to communicate in a one-way, transmit only system with a bridge unit 200, though it is equally anticipated that the temperature measuring devices 300 communicate directly with the cellular network 103 or wide area network 107 through any wireless protocols such as 802.11 (Wi-Fi), Bluetooth, etc., either one-way or bi-directional transmission.

In one embodiment, the system for temperature monitoring and alerting records temperature data transmitted from a plurality of temperature measuring devices 300 via a wide area network 107 such as the internet to a server computer 102.

Figure 2:
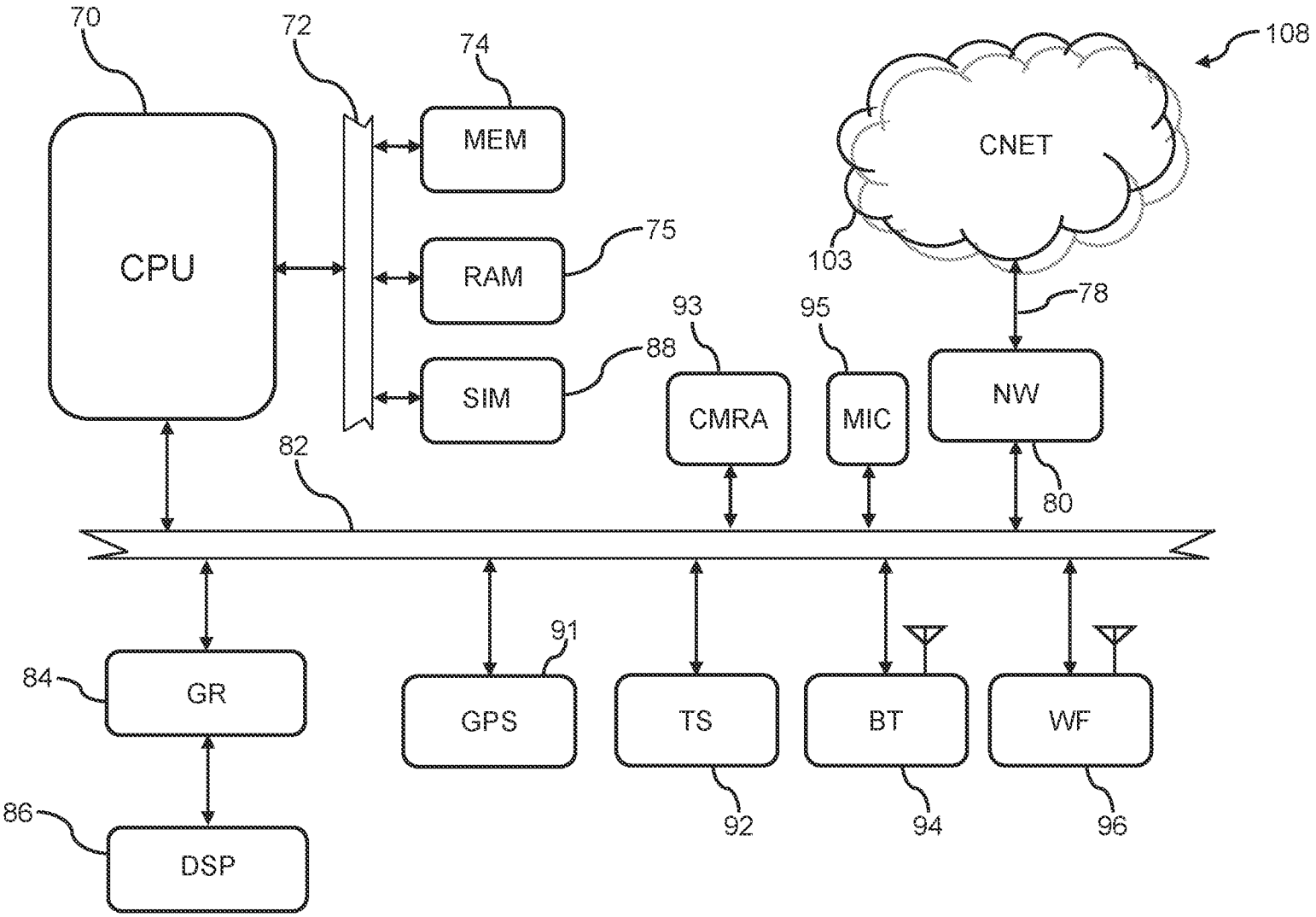
FIG. 2 illustrates a schematic view of a typical cell phone used in the system for temperature monitoring and alerting.

Referring to FIG. 2, a schematic view of a typical cell phone 108 is shown. The example cell phone 108 represents a typical phone system used for accessing user interfaces (e.g., see FIG. 4) of the system for temperature monitoring and alerting. This exemplary cell phone 108 is shown in a typical form. Different architectures are known that accomplish similar results in a similar fashion and the present invention is not limited in any way to any particular cell phone 108 system architecture or implementation. In this exemplary cell phone 108, a processor 70 executes or runs programs in a random access memory 75. The programs are generally stored within a persistent memory 74 and loaded into the random access memory 75 when needed. Also accessible by the processor 70 is a SIM card 88 (subscriber information module) having a subscriber identification and often persistent storage. The processor 70 is any processor, typically a processor designed for phones. The persistent memory 74, random access memory 75, and SIM card are connected to the processor by, for example, a memory bus 72. The random access memory 75 is any memory suitable for connection and operation with the selected processor 70, such as SRAM, DRAM, SDRAM, RDRAM, DDR, DDR-2, etc. The persistent memory 74 is any type, configuration, capacity of memory suitable for persistently storing data, for example, flash memory, read only memory, battery-backed memory, magnetic memory, etc. In some typical cell phones 108, the persistent memory 74 is removable, in the form of a memory card of appropriate format such as SD (secure digital) cards, micro-SD cards, compact flash, etc.

Also connected to the processor 70 is a system bus 82 for connecting to peripheral subsystems such as a cellular network interface 80, a graphics adapter 84 and a touch screen interface 92. The graphics adapter 84 receives commands from the processor 70 and controls what is depicted on a display image on the display 86. The touch screen interface 92 provides navigation and selection features.

In general, some portion of the persistent memory 74 and/or the SIM card 88 is used to store programs, executable code, phone numbers, contacts, and data, etc. In some embodiments, other data is stored in the persistent memory 74 such as audio files, video files, text messages, etc.

The peripherals are examples and other devices are known in the industry such as Global Positioning Subsystem 91, speakers, microphones, USB interfaces, Bluetooth transceiver 94, Wi-Fi transceiver 96, camera 93, microphone 95, image sensors, etc., the details of which are not shown for brevity and clarity reasons.

The cellular network interface 80 connects the cell phone 108 to the cellular network 103 through any cellular band and cellular protocol such as GSM, TDMA, LTE, etc., through a wireless medium 78. There is no limitation on the type of cellular connection used. The cellular network interface 80 provides voice call, data, and messaging services to the cell phone 108 through the cellular network.

For local communications, many cell phones 108 include a Bluetooth transceiver 94, a Wi-Fi transceiver 96, or both. Such features of cell phones 108 provide data communications between the cell phones 108 and data access points and/or other computers such as a server computer 102.

Figure 3:
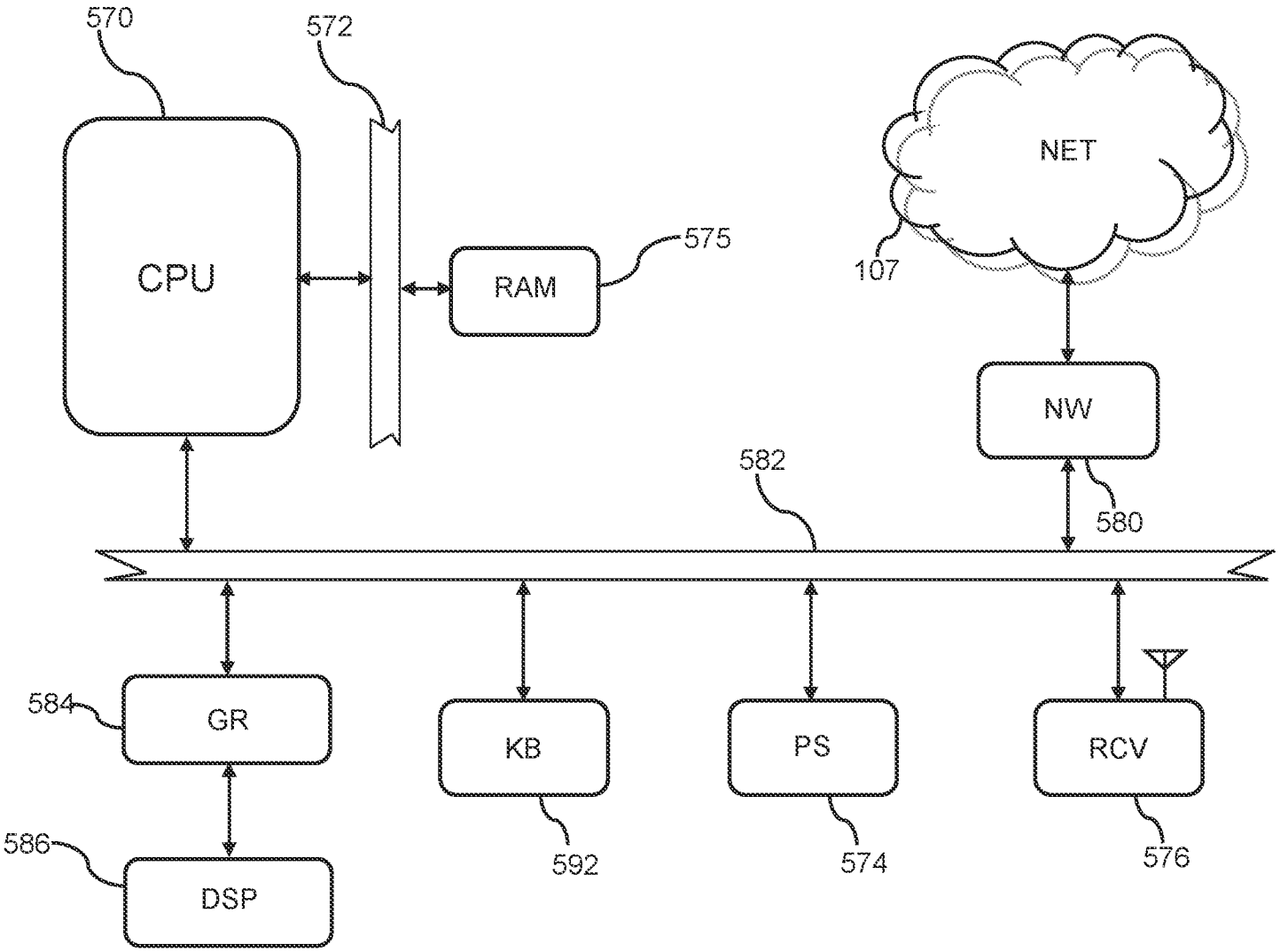
FIG. 3 illustrates a schematic view of a typical computer system such as a server or micro-controller.

Referring to FIG. 3, a schematic view of a typical computer (e.g., server computer 102 or bridge unit 200) is shown. The example computer system represents a typical computer system used for back-end processing, generating reports, displaying data, etc. This exemplary computer system is shown in its simplest form. Different architectures are known that accomplish similar results in a similar fashion and the present invention is not limited in any way to any particular computer system architecture or implementation. In this exemplary computer system, a processor 570 executes or runs programs in a random access memory 575. The programs are generally stored within a persistent memory 574 and loaded into the random access memory 575 when needed. The processor 570 is any processor, typically a processor designed for computer systems with any number of core processing elements, etc. The random access memory 575 is connected to the processor by, for example, a memory bus 572. The random access memory 575 is any memory suitable for connection and operation with the selected processor 570, such as SRAM, DRAM, SDRAM, RDRAM, DDR, DDR-2, etc. The persistent memory 574 is any type, configuration, capacity of memory suitable for persistently storing data, for example, magnetic storage, flash memory, read only memory, battery-backed memory, magnetic memory, etc. The persistent memory 574 is typically interfaced to the processor 570 through a system bus 582, or any other interface as known in the industry.

Also shown connected to the processor 570 through the system bus 582 is a network interface 580 (e.g., for connecting to a data network 107), a graphics adapter 584 and a keyboard interface 592 (e.g., Universal Serial Bus—USB). The graphics adapter 584 receives commands from the processor 570 and controls what is depicted on a display image on the display 586. The keyboard interface 592 provides navigation, data entry, and selection features.

In general, some portion of the persistent memory 574 is used to store programs, executable code, data, contacts, and other data, etc.

The peripherals are examples and other devices are known in the industry such as speakers, microphones, USB interfaces, Bluetooth transceivers, Wi-Fi transceivers, image sensors, temperature measuring devices, etc., the details of which are not shown for brevity and clarity reasons.

In the server computer 102 or bridge unit 200, a receiver device 576 provides data communications with the transmitters 300*e* of each temperature measuring device 300/380/390. In some embodiments, the receiver device 576 is designed to receive signals of the agreed protocol(s) and frequency or frequencies on which the transmitters 300*e* of each temperature measuring device 300/380/390 transmit. In some embodiments, the receiver device 576 also includes a transmit capability to respond/acknowledge/control the temperature measuring device 300/380/390, for example, for disabling a temperature measuring device 300/380/390 or updating firmware in a temperature measuring device 300/380/390.

Figure 4:
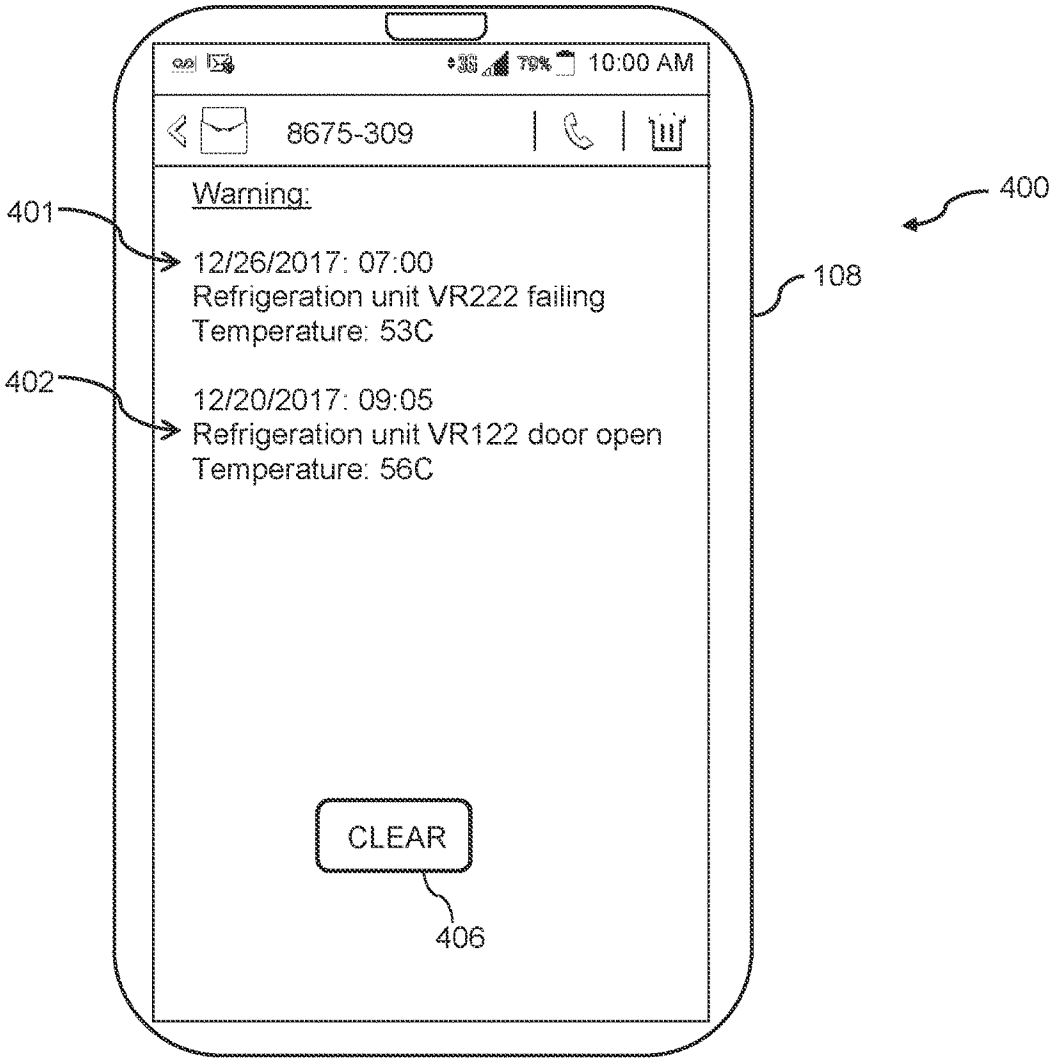
FIG. 4 illustrates an exemplary cell phone user interface of the system for temperature monitoring and alerting showing text alerts.

Referring to FIG. 4, an exemplary cell phone user interface of the system for temperature monitoring and alerting is shown. Although many user interfaces are anticipated, one example user interface is a text message user interface 400 that is used to inform of issues related to one or more refrigeration units 399 (see FIGS. 5 and 6). The text message user interface 400 runs on a cell phone 108 or another device. When the messaging application runs, for example, on the user's cell phone 108, the messaging application communicates with the server computer 102, receiving messages that include status and alerts. In this example, a first alert 401 has been received indicating that the refrigeration unit 399 (VR222) is failing, along with the current temperature of that unit (53 degrees C.) and the date/time of the alert (7:00 on Dec. 26, 2017). Further in this example, a second alert 402 has been received indicating that another refrigeration unit 399 (VR122) has an open door, along with the current temperature of that unit (56 degrees C.) and the date/time of the alert (9:05 on Dec. 20, 2017). In some embodiments, once the alert is tended to, a clear operation 406 is invoked.

Figure 5:
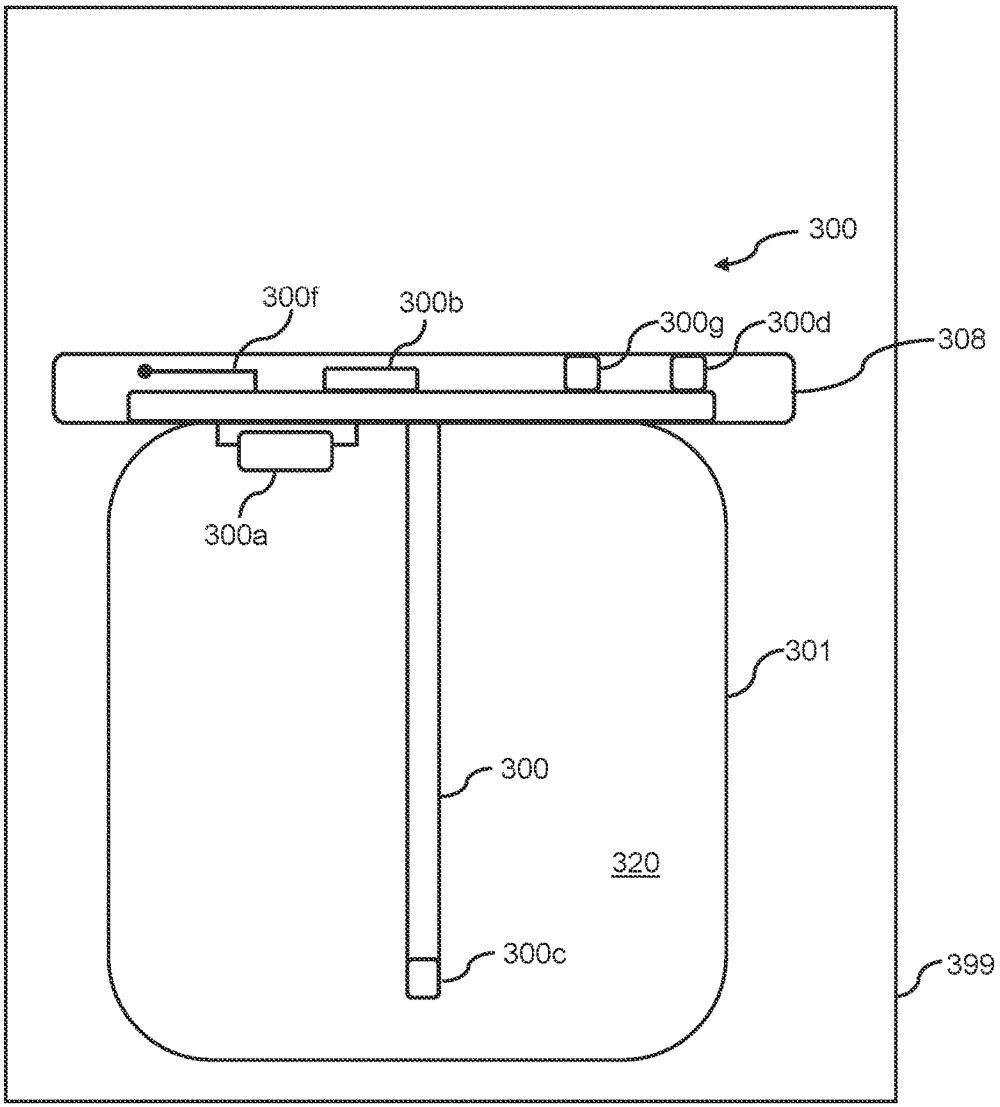
FIG. 5 illustrates a plan view of temperature measuring device of the system for temperature monitoring and alerting.
Figure 6:
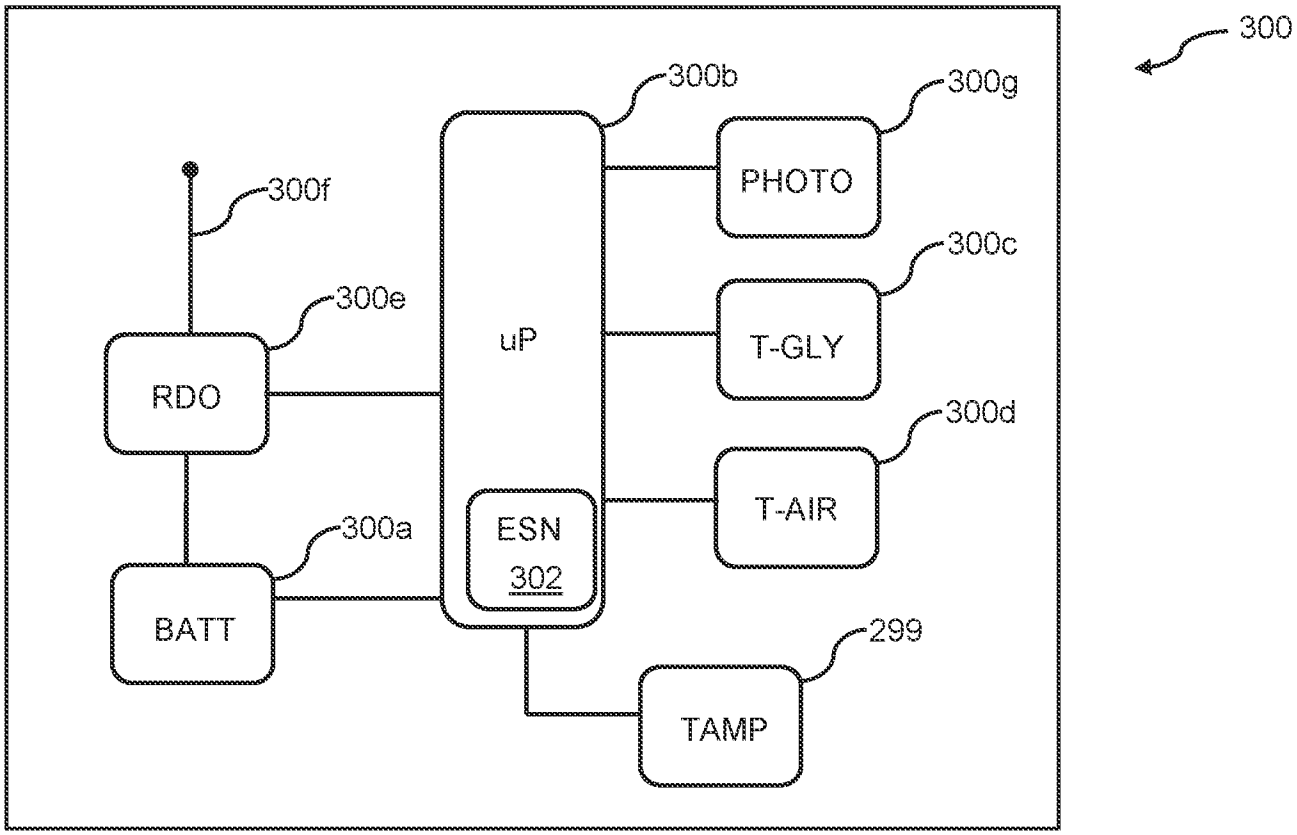
FIG. 6 illustrates block diagram of the temperature measuring device of the system for temperature monitoring and alerting.

Referring to FIGS. 5 and 6, examples of temperature measuring devices 300 are shown. The temperature measuring devices 300 are battery-powered and a transmitter 300*e* (or transceiver) transmits messages to systems external to the refrigeration unit 399; either to a bridge unit 200 or directly to the server computer 102 through a wireless local area network or through the cellular network 103, in some embodiments through encrypted RF transmissions. As power consumption of the temperature measuring devices 300 is important, less power is required to communicate in a one-way, transmit only system with a bridge unit 200, though it is equally anticipated that the transmitter 300*e* of the temperature measuring devices 300 communicate to external systems in any mode possible, including directly through the cellular network 103 or wide area network 107 using any wireless protocols such as LTE, 3G, 4G, 5G, 802.11 (Wi-Fi), Bluetooth, etc.

In some embodiments, the sensors 300*c*/300*d*/300*g*/299 connect directly to the transmitter 300*e* and logic of the transmitter 300*e* determines when to transmit data from the sensors 300*c*/300*d*/300*g*/299. In such, it is anticipated that the transmitter 300*e* have an address (e.g., MAC address) that is used to identify each temperature measuring devices 300.

To maximize life of the battery 300*a* used by the temperature measuring devices 300, it is anticipated that in some embodiments, the processor 300*b* within the temperature measuring device 300 remains in sleep mode most of the time. In such, when the processor 300*b* wakes up, preferably at factory-set intervals, the processor 300*b* samples the temperature of a first temperature sensor 300*c* that is embedded/submerged in a mass of dense material, for example, glass beads or glycol, measuring a buffered temperature. It is anticipated that the mass 320 (e.g., glass beads or propylene glycol) is contained within a container 301. In some embodiments, the processor 300*b* also samples the temperature of an ambient air temperature within the refrigeration unit 399 by reading a second temperature sensor 300*d*. In some embodiments, the processor 300*b* samples ambient light levels by reading a light sensor 300*g*.

Although the temperature measuring devices 300 is shown having two temperature sensors 300*c*/300*d*, in some embodiments only a single temperature sensor 300*c*/300*d* is present, for example, only the first temperature sensor 300*c* that is submerged (e.g., in propylene glycol or glass beads); or only the second temperature sensor 300*d* for measuring ambient air temperature within the refrigeration unit 399. In embodiments in which the first temperature sensor 300*c* (e.g., submerged in propylene glycol) is the only temperature sensor present, the cycling pattern of the compressor of the refrigeration unit 399 is derived by comparing temperature readings from the first temperature sensor 300*c* compared to an average of temperature readings from the first temperature sensor 300*c*. In embodiments in which only the second temperature sensor 300*d* is present, the buffered temperature is derived by averaging of temperature readings from the second temperature sensor 300*d*.

In embodiments in which a bridge unit 200 is present, the micro-controller initiates an RF transmission from the transmitter 300*e* to the bridge unit 200, including measurements from each sensor 300*c*/300*d*/300*g* that is present. In some embodiments, the RF transmission is encrypted. The transmission includes any or all of the temperature data from the temperature sensors 300*c*/300*d*, a factory-set electronic serial number 302 of the temperature measuring device 300 (or other identification data), a status of the battery 300*a*, a measurement of light within the refrigeration unit 399 from the light sensor 300*g*, and in some embodiments, a status of a tamper switch 299.

In embodiments having a bridge unit 200, when the message is received by the bridge unit 200, the message is stored within a persistent memory 574 of the bridge unit 200 until the bridge unit 200 initiates a transmission to the server computer 102.

The server computer 102 stores within the data storage 109 various data such as temperature history, high and low temperature set points, light history, etc., for each temperature measuring device 300.

When the server computer 102 receives a message from a bridge unit 200, the temperature data from each temperature measuring device 300 is stored in a database/data storage 109.

Upon receipt of the data from one or more temperature measuring devices 300, the server computer 102 process the data received from each temperature measuring device 300 to determine whether or not an alert response is required.

If the received temperature data meets certain criteria, the server initiates a response to alert a user about this condition (see FIG. 4 for an example).

In some embodiments, the server computer 102 initiates an alert when a temperature measuring device 300 or bridge unit 200 fails to communicate to the server computer 102 for a predetermined amount of time.

In some embodiments, the server computer 102 initiates an alert when a temperature measuring device 300 or bridge unit 200 is tampered with or if a trouble condition exists, such as a low battery level within the temperature measuring device 300.

In most embodiments, alerts are sent to one or more cell phones 108 or any other user device, for example, in the form of a short-message-system message (SMS text) transmitted, for example, from the server computer 102 through the wide area network 107 through the cellular network 103 to one or more cell phones 108. In some embodiments, each alert is sent to an application running on a cell phone 108 and the application confirms reading of the alert as well as requests an acknowledgement to the alert. In some embodiments, the camera 93 of the cell phone 108 is used to capture and log proof of responses to an alert. Such proof is important in certain scenarios, for example, moving the medications to an ice chest or alternate refrigeration unit 399 after a refrigeration failure is detected.

In some embodiments, alerts are sent to users via email messages sent from the server computer 102 through the wide area network 107.

In some embodiments, alerts are sent via voice over telephone calls from the server computer 102 to the subscriber's cell phone 108 via automated voice messages from the server computer 102.

In some embodiments, alerts are sent from the server computer 102 to cell phones 108 via SMS or smartphone application running on the phones 108.

In some embodiments, each temperature measuring device 300 has a unique and separate set of alerts for each condition. For example, each temperature measuring device 300 has a serial number that is included in the alerts and/or is translated to a name (e.g. "refrigeration unit 1") and the name is included in the alert.

A typical alert includes sending an email and/or SMS message when a temperature measuring device 300 reads temperature rising above, or falling below temperature thresholds specified by the user for a particular temperature measuring device 300. In some embodiments, the user specifies how long the temperature reported by each temperature measuring device 300 needs to exceed the specified alert temperature thresholds before an alert is initiated. This time allows the temperature to be outside of the specified temperature parameters for brief periods of time, such as when refrigerator doors are opened for brief periods of time. This delay period also eliminates false alarms during refrigeration defrost cycles.

It is anticipated that all settings and alerts are configurable by the subscriber, for example using a web-based software application running on the server computer 102. It is also anticipated that the user has access to each temperature measuring device's 300 historical temperature data via the same web-based application on the server computer 102.

In one embodiment, software on the server computer 102 analyzes the temperature data received from a temperature measuring device 300 to determine whether or not the refrigeration system is functioning properly.

The temperature within a refrigerator or freezer is generally constantly changing. In almost all cases of normal refrigerator/freezer unit's operation, the units begin warming soon after the compressor stops and then begin cooling when the compressor restarts. When the refrigerator doors remain closed, the on/off cycling pattern of the compressor occurs at fairly regular and predictable intervals.

In many industries, it is possible that power to refrigeration units 399 is disconnected by accident. For example, in the food and restaurant industry, freezer power cords are accidentally removed during the shutdown or cleanup procedures at the closing time of the establishments. As another example, circuit breakers are un-intentionally switched off to refrigeration units 399 when personnel intend to turn off lighting and signage at closing.

Typically, when power is turned off to a refrigeration unit 399, it takes several hours for the temperatures to slowly rise to critical or near-critical levels before a problem is even detected. In the case of restaurants closing—many of which shutdown between 11 PM and 2 AM—by the time the temperature reaches a threshold, the alert is not delivered until the personnel have already gone home and are often sound asleep many hours after the problem was initially created.

It is therefore extremely desirable to detect when a compressor fails to operate in a minimal amount of time, as this provides very early warning of a temperature problem.

Although the cycle-rate of compressors vary among refrigeration units 399, they typical on/off cycle time ranges from 6 to 12 minutes.

The temperature data received by the server computer 102 is averaged over a specified time (e.g., 60 minutes).

When the temperature received rises above this average, or falls below this average temperature (e.g., allowing for a specified hysteresis value, typically of 0.25° F.), a compressor cycle is validated as RISE CYCLE (in the case of the air rising above the average) and the compressor cycle is validated as a LOW CYCLE in the latter case where the temperature falls below the average temperature.

This averaging and hysteresis function is performed in software, either in the server computer 102 or processor 300*b* or, in some embodiments, this averaging and hysteresis function is performed in hardware of the temperature measuring device 300 using conventional analog operational amplifier circuits that employ an averaging technique comprised of a combination of a bias level and a time constant interval, for example, implemented using a voltage level proportional to the temperature and a timer that will expire when the zero-crossing pattern is not performed within a specified time period.

As federal requirements dictate the need to buffer a temperature sensor, the temperature measuring device 300 includes two temperature sensors. A first temperature sensor 300*c* is submerged in a buffer or mass 320 (a solid mass such as glass beads or a liquid mass e.g., propylene glycol) so that the first temperature sensor 300*c* reads a buffered temperature of the refrigeration unit 399.

As the buffer or mass 320 (e.g., solid or solution such as propylene glycol) surrounding the first temperature sensor 300*c* increases, so does the difficulty to detect small changes in the surrounding air temperature and the ability to analyze the compressor patterns. Therefore, in a preferred embodiment, the temperature measuring device 300 includes a second temperature sensor 300*d* which is exposed to ambient air within the refrigeration unit 399. The second temperature sensor 300*d* is fluidly interfaced to ambient air around the temperature measuring device 300, for measuring instantaneous temperatures within the refrigeration unit 399 for analysis of the compressor cycle pattern and operation of the door to the refrigeration unit 399.

In one embodiment, real-time temperature data is transmitted to the server at a rate of once per minute as analyzing of the compressor cycling is more easily accomplished with server based software as opposed to on-board hardware and software, although it is equally anticipated that the analysis and tracking is performed at a local computing entity such as the bridge unit 200.

The Center for Disease Control (CDC) and many state health agencies either mandate or recommend the use of a buffer solution such as glycol bottle to "average" the air temperature data measurements from refrigerator and freezer units that contain vaccines and other pharmaceuticals.

Until state and federal regulations acknowledge mathematical formulas to replace the glycol-based temperatures, one embodiment uses two temperature sensors. The first temperature sensor 300*c* reads the temperature within the buffer or mass 320 (any liquid or solid having mass) which is slow-changing (not responsive to fast changes in temperature within the refrigeration unit 399) and provides data as required by CDC and state requirements. The second temperature sensor 300*d* measures the fast-changing air temperature within the refrigeration unit 399 and provides instantaneous temperature data that is used to analyze and process compressor cycles, and ultimately, used to model the refrigeration operational characteristics and predict/determine failures.

In another embodiment only one the first temperature sensor 300*c* is present. In this embodiment the average temperature is derived from the single sensor, regardless of whether the sensor is in ambient air or submerged in a buffer or mass 320 (e.g., glass beads or glycol). It is anticipated that it will be more difficult to detect subtle changes in air temperature with the only sensor submerged in a buffer or mass 320.

Compressor/refrigeration problems are detected within minutes of a refrigeration fault condition, thereby enabling the responder to correct the problem before the contents of the refrigeration unit 399 are exposed to critical or near-critical temperatures.

Prior systems in existence today operate to generate alerts only when the temperatures have exceeded specified levels for specified periods of time. To minimize false alarms, these levels are generally set to the highest acceptable levels placing the contents of the refrigeration units 399 in danger or near-dangerous conditions before a corrective action is initiated.

In operation, there are at least two conditions in which a compressor-cycle pattern produces non-symmetrical or irregular temperature patterns. One of these conditions occurs when the refrigeration unit 399 is in defrost mode. When in defrost mode, two things occur. The cycle-interval between temperature increases and decreases becomes longer and the rate-of-rise for the air temperature increases significantly during the compressor cycle.

To avoid an invalid alarm generated when the compressor cycle period exceeds the specified value (i.e., 30 minutes). The server analyzes the temperature data between the current temperature reading and the last known validated cycle transaction time. If the rate-of-rise and the peak temperature value from the first temperature sensor 300*c* (within a buffer or a mass 320) is significantly higher than the average temperature from the first temperature sensor 300*c* during the period since the last valid compressor cycle transition, it is assumed that either a defrost cycle occurred or the door to the refrigeration unit 399 is open. If it is detected that a significant rate-of-rise in the ambient temperature from the second temperature sensor 300*d* (exposed to ambient within the refrigeration unit 399) during the period following the last valid compressor transition time, the delay-until-alarm period is increased by a specified period (i.e. instead of generating an alarm in 30 minutes, waiting 60 or 90 minutes) for the cycle pattern to return to a more frequent, normal state following the end of the defrost cycle, or after the door is closed.

State and federal agencies require or recommend the use of water-filled bottles in both freezers and refrigerators. These bottles of water add mass and will extend the time in which refrigeration units 399 can maintain their temperatures in the event of refrigerator failure or power loss. In many cases, the temperature sensors 300*c*/300*d* are wrongly positioned underneath bags of ice in freezers or surrounded by cold objects in refrigerators and do not indicate temperature problems because their temperature readings are being masked by the surrounding cold objects. The above described system closely monitors the on/off compressor cycling of the refrigeration units 399, detecting a "flat line" reading that occurs when a cold object is placed on or around the sensors 300*c*/300*d* and an alert is generated, indicating that analysis is non-functional due to the ice or other object.

Additionally, when the on/off compressor cycle pattern occurs too frequently, an alert is generated representative of a refrigeration unit 399 not holding sufficient temperature during the "off" cycle of a compressor. Typically, this is caused by a door not being fully closed, a leaky seal, or insufficient mass (i.e. water bottles) within the refrigeration unit 399 (used to retain the temperature for a period of time following a catastrophic power failure or refrigeration hardware failure).

In another embodiment, the above described, temperature zero-crossing detection method is enhanced or substituted with algorithms that process the real-time or stored temperature data.

In another embodiment the above described, temperature zero-crossing detection method is performed within a microcontroller within the temperature measuring device 300, or within the bridge unit 200, or in on-site hardware such as a local computer, or microcontroller-based device.

State and federal health agencies require that health care providers perform routine visual inspections of their temperatures. For example, temperature monitoring devices for vaccines are required to capture and timestamp when a staff views or "inspects" the temperatures. The required interval for checking or inspecting temperatures is typically at least twice daily.

The corrective action data is placed directly on the timeline of a temperature graph. A temperature problem is then associated with the solution. All system information is also displayed on the graph using various icons to display different types of data. The timeline includes, for example, change-log data, corrective action data, temperature alerts, temperature inspections, etc.

In some embodiments, a floor plan or site map is provided, displaying data from multiple temperature measuring devices 300 simultaneously. The floor plan simplifies visual supervision and is used to determine when multiple temperature measuring devices 300 are affected by the same cause such as a particular warm section of a building, an electrical problem or a coolant circuit problem. The floor plan also facilitates fast error-free identification of problem s with temperature measuring devices 300.

In one embodiment the sensors are administratively added through software using drag-and-drop followed by a window interface that collect the sensor's ESN (electronic serial number), name, location, specific settings, etc. In another embodiment the sensor's barcoded ESN is read using a camera 93 of a cell phone 108 or other device/scanner. After scanning the barcoded ESN, the user touches the screen on the mobile device (e.g., cell phone 108) at the location of the floorplan where the device is to be placed. Once placed, the user is prompted to enter the device name and other specific data for that device. This method simplifies the addition devices to a floor plan and reduces errors related to manual entry of serial numbers.

In some embodiments, the temperature measuring devices 300 includes a light sensor 300*g* that is exposed to ambient lighting conditions within the refrigeration unit 399. The light sensor 300*g* measures light around the temperature measuring devices 300 and the ambient light level is used to determine when a door to the refrigeration unit 399 is open, either from light entering the refrigeration unit 399 from outside of the refrigeration unit 399 or from light produced by a light (bulb, LED, etc.) internal to the refrigeration unit 399.

Figure 7:
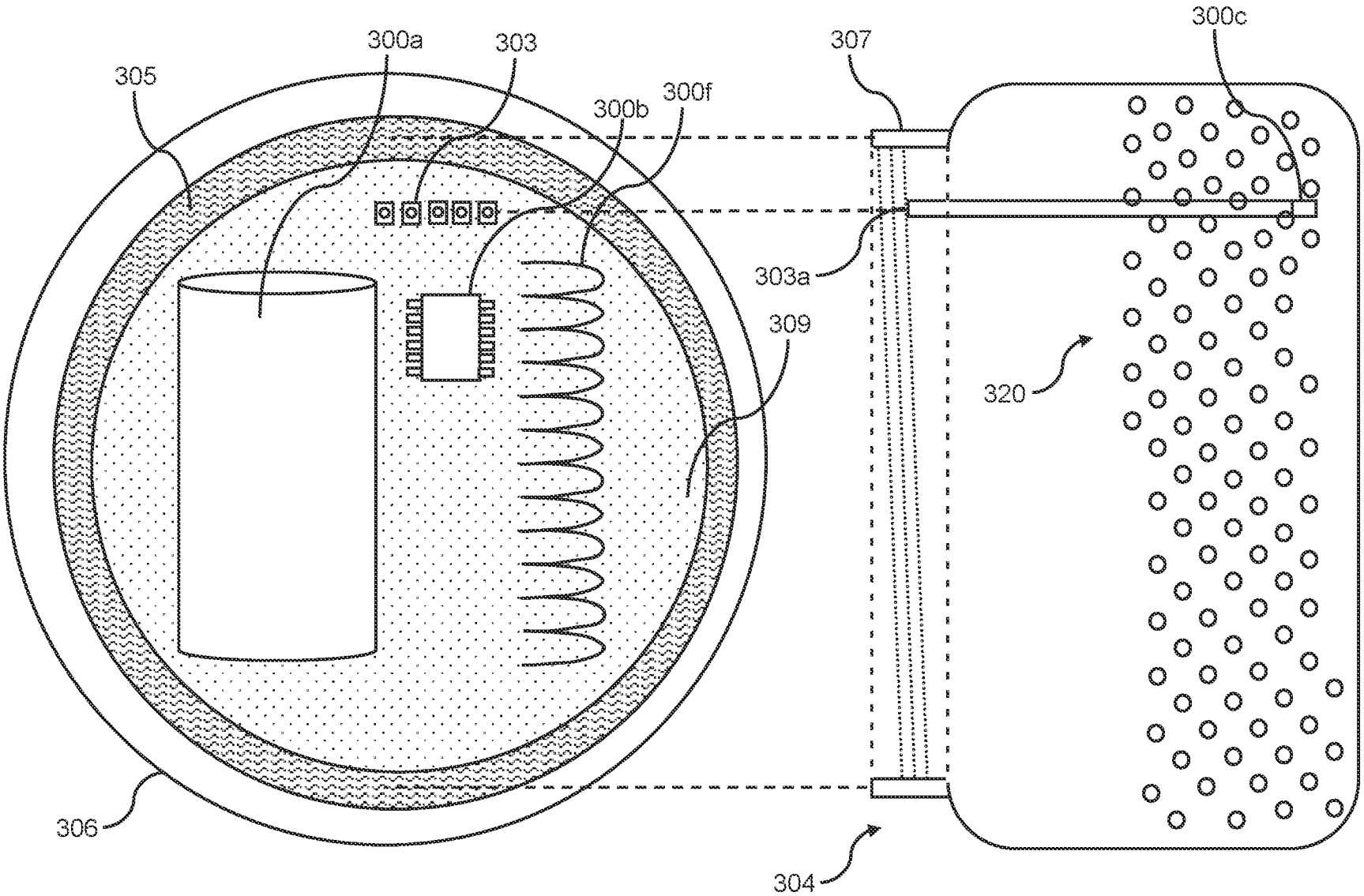
FIG. 7 illustrates a partially exploded view of an embodiment of the temperature measuring device of the system for temperature monitoring and alerting.

As shown in FIG. 7, in some embodiments, the temperature measuring devices 300 are housed in an enclosure 301/308, for example, an enclosure 301/308 in the shape of a bottle 301 with a lid 308. The electronics including the processor 300*b*, the antenna 300*f*, the optional light sensor 300*g* (not visible, on opposite side of circuit board 309), the second temperature sensor 300*d* (not visible, on opposite side of circuit board 309) and a battery 300*a* are mounted to a circuit board 309 that is affixed inside of a lid of the container. In this embodiment, the first temperature sensor 300*c* is connected to the circuit board 309 and processor 300*b* by a connector pair 303/303*a* (e.g., a female connector 303 and male counterpart connector 303*a*). In some embodiments, a gasket 305 seals between the lid 306 and the lip 307 of the container (e.g. jar 304). In this embodiment, the buffer or mass 320 comprises a plurality of glass beads.

As the temperature measuring devices 300 are battery operated, battery management is important. Even with a battery 300*a* having reasonable capacity and the above noted mechanisms to keep power usage to a minimum, eventually, the battery 300*a* will discharge to a point where the temperature measuring device 300 no longer functions. At that time, the battery 300*a* needs to be replaced and, as the temperature measuring device 300 includes a buffer or mass 320, it is difficult to change the battery 300*a* by an end user and, often, it is required that the temperature measuring device 300 be returned to the manufacturer for battery replacement, leaving the refrigeration unit 399 without monitoring until the temperature measuring device 300 is returned with a fresh battery 300*a*.

To overcome this shortcoming, the temperature measuring device 380 and temperature measuring device 390 (see FIGS. 8-11) include a rechargeable battery 700*a*. Note that the electronics, temperature sensing, light sensing, and data transmission are the same or similar to that of the temperature measuring device 300, only using a rechargeable battery 700*a*. Many electronic devices include rechargeable batteries, typically with connectors for providing charging current. Although it is feasible and anticipated that the temperature measuring device 380 and temperature measuring device 390 include a connector (e.g., mini-USB connector) for recharging, such connectors are difficult to maintain in refrigeration units in which condensation often occurs when the refrigeration door is open. It is also known that many electronic devices include wireless charging, for example many of today's smartphones use wireless inductive charging. Therefore, to provide recharging capabilities, the temperature measuring device 380 and temperature measuring device 390 utilize wireless charging, for example, inductive wireless charging, to recharge the rechargeable battery 700*a* without removal of the rechargeable battery 700*a* from the temperature measuring device 380/390.

It is known that recharging often requires a certain amount of "down time." As the temperature measuring device 380 and temperature measuring device 390 are often required to operate 24/7, it is anticipated that a "hot spare" be used. In this, once a battery-low signal is received from one temperature measuring device 380 or temperature measuring device 390, a second (hot spare) temperature measuring device 380 and temperature measuring device 390 is placed in the same refrigeration unit 399 and allowed to reach operating temperature. Then, software is updated to receive data from the second temperature measuring device 380/390 and the unit with the low-battery is removed from the refrigeration unit 399. After the unit with the low-battery is removed from the refrigeration unit 399, it is recharge using a wireless recharger and then becomes the "hot spare." Using this method, continuous monitoring of the refrigeration unit is performed using one "hot spare" for several refrigeration units 399.

Figure 8:
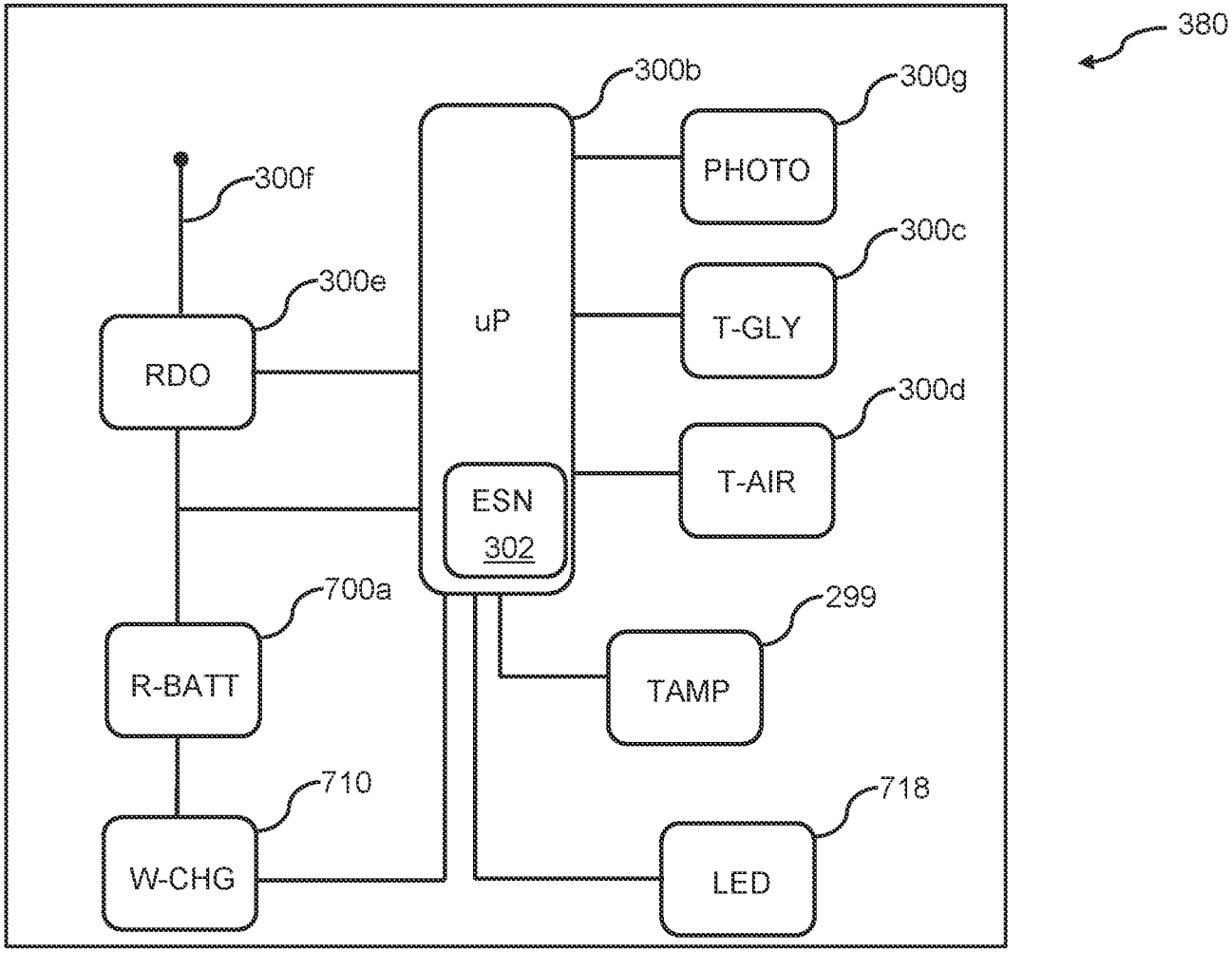
FIG. 8 illustrates a plan view of temperature measuring device of the system for temperature monitoring and alerting with wireless charging.

FIG. 8 illustrates a plan view of temperature measuring device 380 of the system for temperature monitoring and alerting with wireless charging. Most components of the temperature measuring device 380, except instead of a battery 300*a*, the temperature measuring device 380 has a rechargeable battery 700*a* along with a wireless charge receiver circuit 710. The wireless charge receiver circuit 710 receives charge current from a wireless charge transmitter 820 (see FIGS. 10 and 11) and provides/controls charge current to recharge the rechargeable battery 700*a*, without requiring external connectors or access to internals of the temperature measuring device 380. The temperature measuring device 380 is simply placed upon an active wireless charge transmitter 820 and the wireless charge receiver circuit 710 provides, monitors, and controls charging power to the rechargeable battery 700*a*. An example of such wireless charging is Qi which is an open interface standard for wireless power transfer. QI uses inductive charging over distances of up to 4 cm.

In some embodiments, the wireless charge circuit 710 also interfaces to the processor 300*b* to provide charge status of the rechargeable battery 700*a* and proper orientation with respect to the wireless charge transmitter 820. In some such embodiments, one or more status LEDs 718 provide charge status and connection status to the wireless charge transmitter 820, either driven by the processor 300*b* or directly by the wireless charge circuit 710.

In some embodiments, upon signaling (see FIGS. 9 and 11), the wireless charge circuit 710 signals the processor 300*b* to enter a deep sleep (minimal power consumption) for shipping and storage, to be woken based upon a different signal from the wireless charge transmitter 820 with modulator 830.

Figure 9:
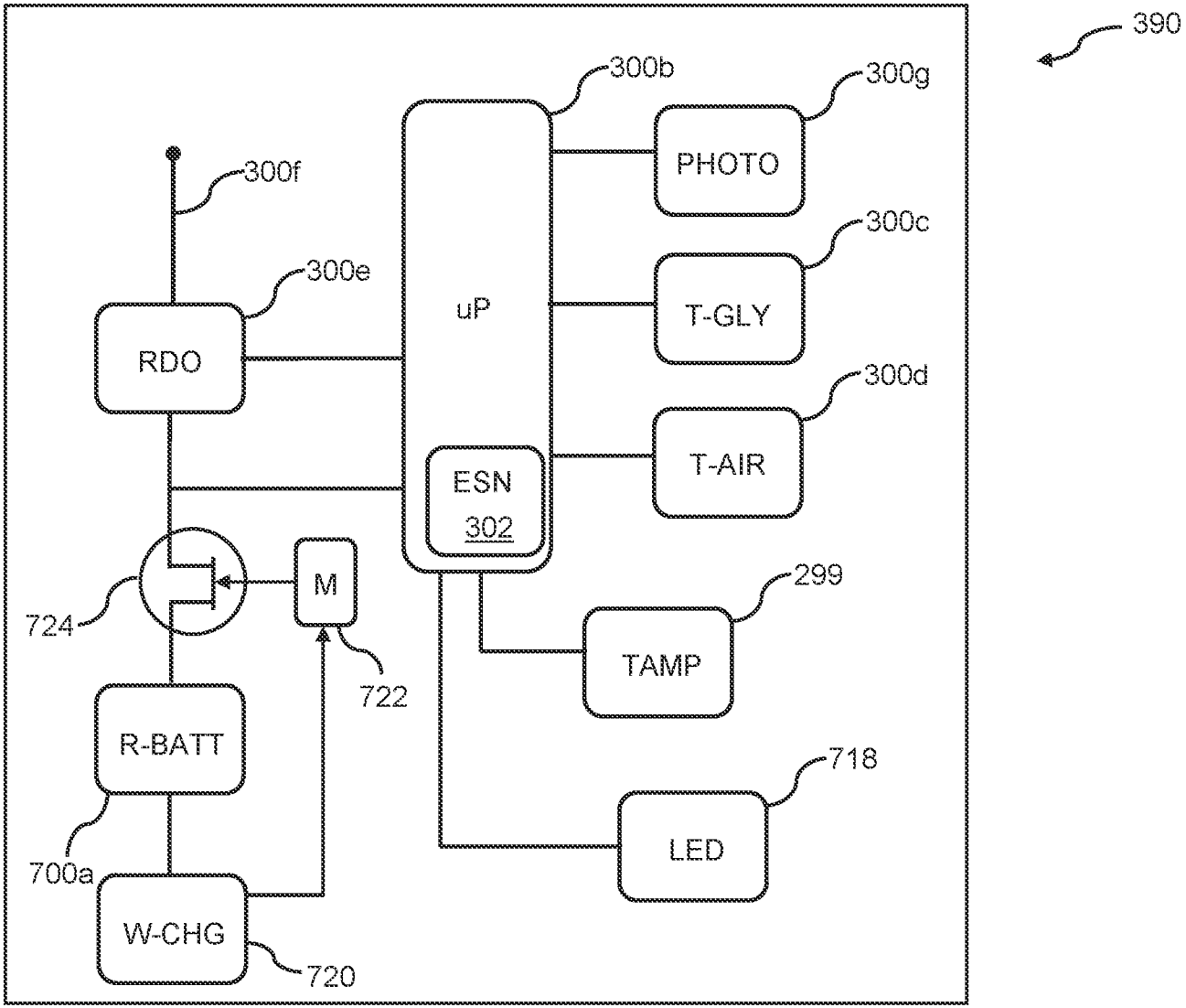
FIG. 9 illustrates a plan view of temperature measuring device of the system for temperature monitoring and alerting with wireless charging and battery disconnect.

FIG. 9 illustrates a plan view of temperature measuring device 390 of the system for temperature monitoring and alerting with wireless charging and battery disconnect. Often, there is a time-lag between manufacturing of the temperature measuring device 380/390 and deployment into a refrigeration unit 399. Rechargeable batteries often self-discharge, but as the circuitry of the temperature measuring device 380/390 consumes power from the rechargeable batteries 700*a*, further discharge will occur during this time-lag. Even a rechargeable battery 700*a* that is fully charged at manufacturing will have reduced capacity by the time the end user deploys this device. To reduce the discharge of the rechargeable battery 700*a* to approximately that of the self-discharge rate, the temperature measuring device 390 includes a discharge circuit that includes a switching device 724 and a memory device 722. During the manufacturing process, the memory device 722 is reset and biases the switching device 724 into a high-impedance state (off), thereby preventing power drain of the rechargeable battery 700*a* by the sensing and reporting circuitry of the temperature measuring device 390. In some embodiments, the switching device is a field-effect transistor (e.g., FET or MOSFET). In some embodiments, the memory device 722 is a capacitor or a single bit persistent memory such as flash memory.

The temperature measuring device 390 is manufactured, stored, and shipped with the memory device 722 in the reset state (off) and, therefore, the rechargeable battery 700*a* sees little drain from other circuitry of the temperature measuring device 390. Before the temperature measuring device 390 is deployed (put into use), the memory device 722 must be set to enable flow of electric current through the switching device 724 to power the other circuitry of the temperature measuring device 390. In one embodiment, this is performed with a modulated power signal from the wireless charge transmitter 820 (see FIG. 11). In normal operation, when within proximity to the wireless charge transmitter 820, a relatively continuous amount of power is provided to the alternate wireless charge receiver circuit 720 for charging the rechargeable battery 700*a*. In order to signal the alternate wireless charge receiver circuit 720 to set the memory device 722 (e.g., charge a capacitor or set a memory bit), the wireless charge transmitter 820 modulated its output power. This modulation is detected by the alternate wireless charge receiver circuit 720 the temperature measuring device 390 and, responsive to detecting the modulated power, the alternate wireless charge receiver circuit 720 sets the memory device 722. Setting of the memory device 722 enables flow of electricity though the switching device 724 and, hence, powers the other circuitry of the temperature measuring device 390. It is also anticipated that the memory device 722 be reset by a different sequence of the modulated power. For example, a modulation of three short pulses of the power will set the memory device (e.g., enable the temperature measuring device 390) and one short, one long, and one short pulse of the modulated power will reset the memory device (e.g., disable the temperature measuring device 390). Other modulation sequences and techniques are fully anticipated and included herein. For example, wireless charging typically operates using power emitted at a specific frequency and the enable/disable communications is anticipated to work by interrupting the power, by modulating a different frequency on the power for enable and another different frequency on the power to disable, or by pulsing a different frequency over the power and using different sequences of pulsing to enable or disable the switching device 724.

Most components of the temperature measuring device 390, except instead of a battery 300*a*, the temperature measuring device 390 has a rechargeable battery 700*a* along with a alternate wireless charge receiver circuit 720. The alternate wireless charge receiver circuit 720 receives charge current and signaling from a wireless charge transmitter 820 (see FIGS. 10 and 11) and provides charge current to recharge the rechargeable battery 700*a*, without requiring external connectors or access to internals of the temperature measuring device 390. The temperature measuring device 390 is simply placed upon an active wireless charge transmitter 820 and the alternate wireless charge receiver circuit 720 provides, monitors, and controls charging power to the rechargeable battery 700*a*. As will be described with FIG.

11, the wireless charge transmitter 820 includes a modulator 830 to modulate the power output of the wireless charge transmitter 820 to signal the alternate wireless charge receiver circuit 720 to enable or disable the switching device 724 and, therefore, either enable power to the other circuitry of the temperature measuring device 390 (e.g., turn on) or disable power to the other circuitry of the temperature measuring device 390 (e.g., turn off).

Figure 10:
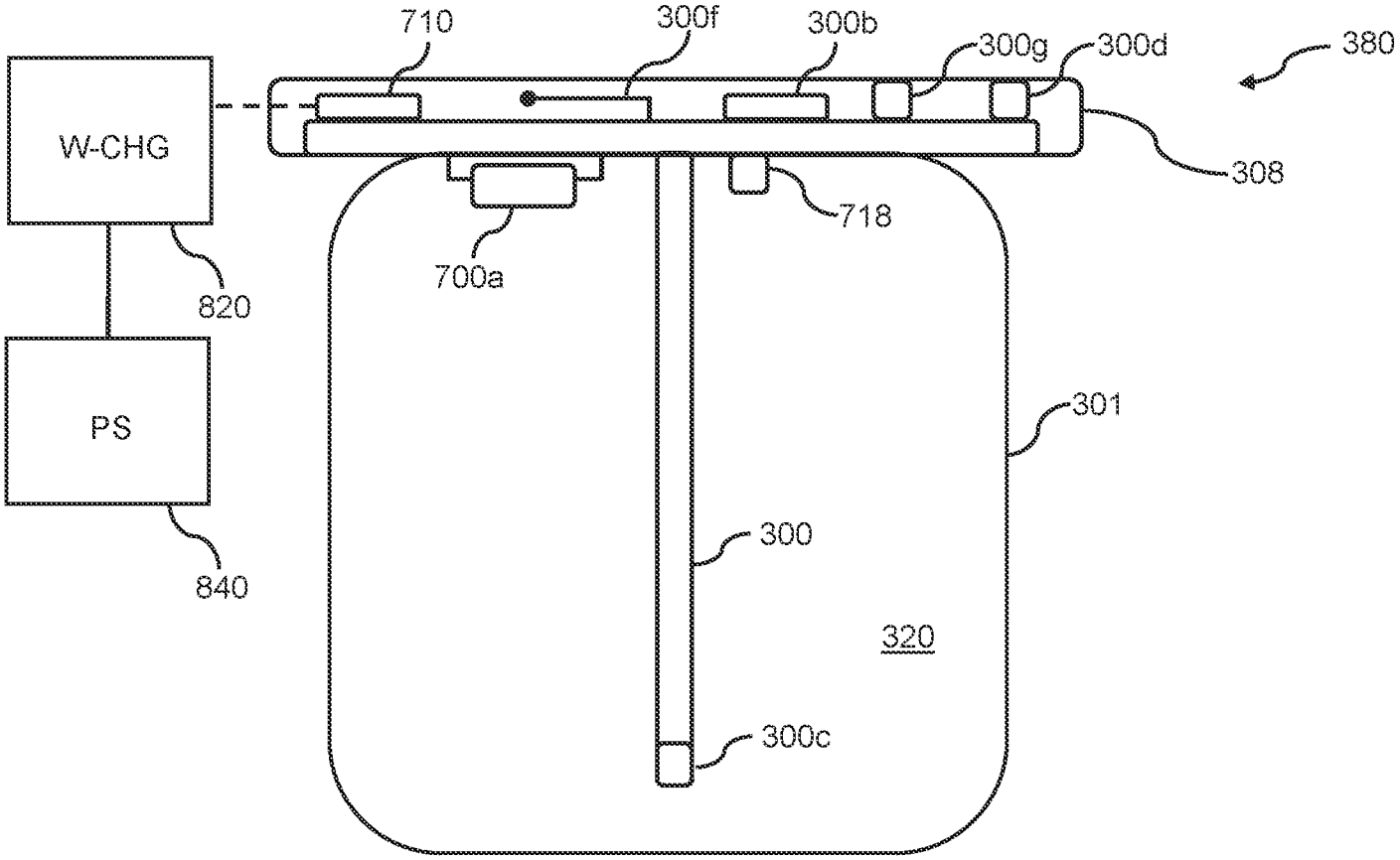
FIG. 10 illustrates a plan view of temperature measuring device and wireless charger of the system for temperature monitoring and alerting with wireless charging.

FIG. 10 illustrates a plan view of temperature measuring device 380 and wireless charge transmitter 820 of the system for temperature monitoring and alerting with wireless charging. The wireless charge transmitter 820 receives power from a power supply 840 and the wireless charge transmitter 820 emits power in proximity to the wireless charge transmitter 820, for example, by way of electromagnetic waves or induction. When power is provided from the power supply 840 and the wireless charge transmitter 820 emits power and the wireless charge receiver circuit 710 is in proximity to the wireless charge transmitter 820, the wireless charge receiver circuit 710 receives some of the emitted power (e.g., using an antenna an power conversion circuit as known in the industry), generating DC power for charging the rechargeable battery 700*a*. Note that the wireless charge receiver circuit 710 includes circuitry to control the charging cycle of the rechargeable battery 700*a* as known in the industry.

Figure 11:
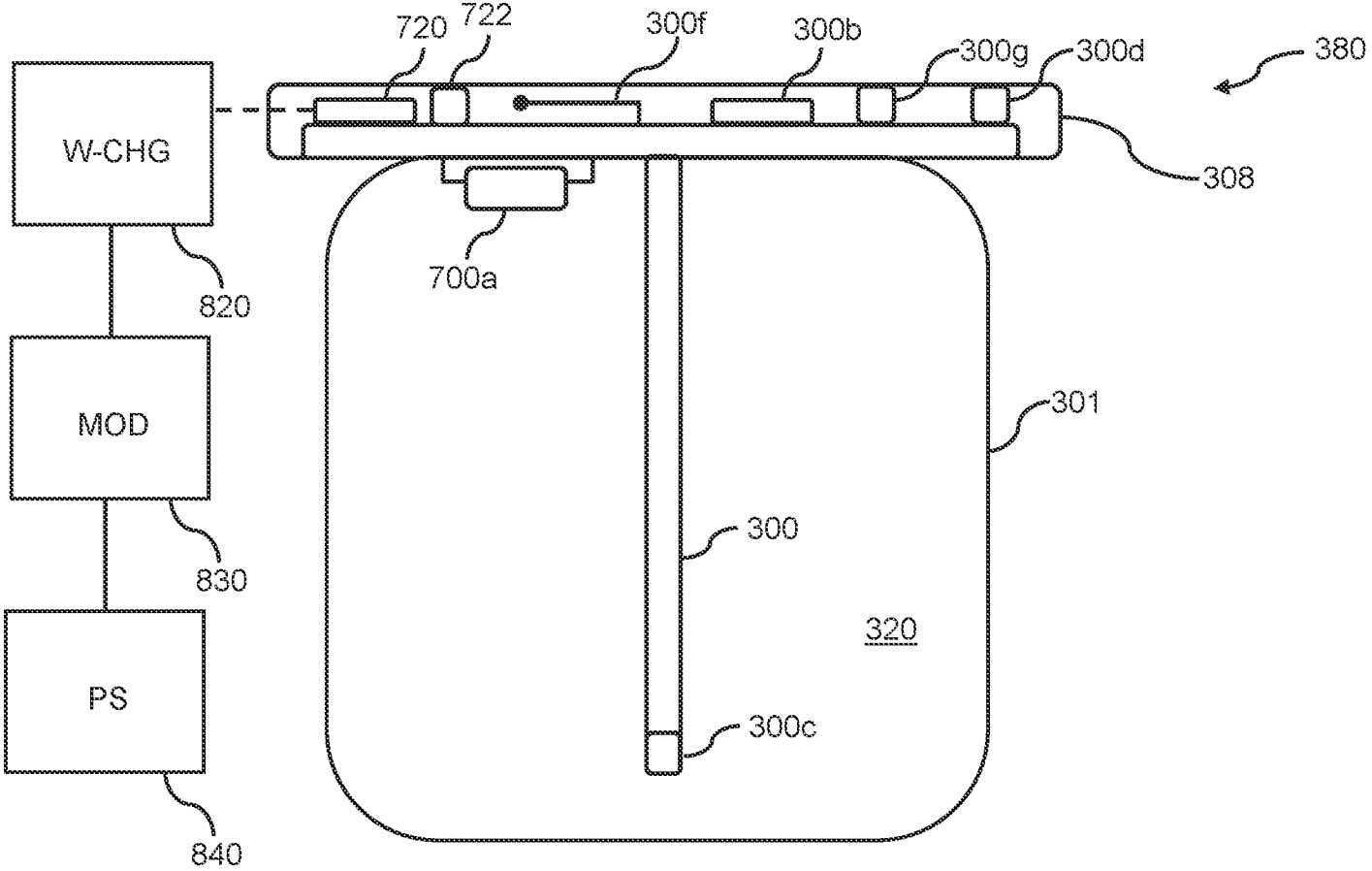
FIG. 11 illustrates a plan view of temperature measuring device of the system for temperature monitoring and alerting with wireless charging enabled for battery disconnect.

FIG. 11 illustrates a plan view of the temperature measuring device 390 of the system for temperature monitoring and alerting with wireless charge transmitter 820 enabled for battery connect/disconnect. The wireless charge transmitter 820 receives power from a power supply 840 and the wireless charge transmitter 820 emits power in proximity to the wireless charge transmitter 820, for example, by way of electromagnetic waves or induction. When power is provided from the power supply 840 and the wireless charge transmitter 820 emits power and the alternate wireless charge receiver circuit 720 is in proximity to the wireless charge transmitter 820, alternate wireless charge receiver circuit 720 receives some of the emitted power (e.g., using an antenna an power conversion circuit as known in the industry), generating DC power for charging the rechargeable battery 700*a*. Note that the alternate wireless charge receiver circuit 720 includes circuitry to control the charging cycle of the rechargeable battery 700*a* as known in the industry. In this embodiment, a modulator 830 is interfaced to the wireless charge transmitter 820. The modulator 830 modulates the power that the wireless charge transmitter 820 emits to either set the memory device 722 (enable) or reset the memory device 722 (disable), controlling the switching device 724 of the circuitry of the temperature measuring device 390. As discussed above, there are many modulation mechanisms anticipated. For example, in one embodiment, the modulator 830 interrupts the power that the wireless charge transmitter 820 emits in predetermined sequences, on sequence to either set the memory device 722 (enable) or reset the memory device 722 (disable), controlling the switching device 724. In another embodiment, the modulator 830 superimposes certain frequencies on the power that the wireless charge transmitter 820 emits, either using two different frequencies or two different sequences of the same frequency which are received by the alternate wireless charge receiver circuit 720; one to set (enable) and the other to reset (disable) the memory device 722, controlling the switching device 724.

Using the modulated power, the wireless charge transmitter 820 and modulator 830 signals the alternate wireless charge receiver circuit 720 of the temperature measuring device 390 to enable or disable power to the other circuitry of the temperature measuring device 390. In this way, it is anticipated that the wireless charge transmitter 820 and modulator 830 at the manufacturing location signals the alternate wireless charge receiver circuit 720 of the temperature measuring device 390 to disable power to the other circuitry of the temperature measuring device 390 to preserve charge during storage and shipping, then, when ready for uses, the wireless charge transmitter 820 and modulator 830 at the deployment location signals the alternate wireless charge receiver circuit 720 of the temperature measuring device 390 to enable power to the other circuitry of the temperature measuring device 390 for normal operation.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A system for monitoring and reporting internal refrigeration unit temperatures, the system comprising:

a temperature measuring device for placement within a refrigeration unit, the temperature measuring device housed within an enclosure and having a first temperature sensor situated in a solid or liquid mass, the first temperature sensor measures a buffered temperature in the solid or liquid mass within the refrigeration unit and the temperature measuring device having a second temperature sensor interfaced to ambient air within the refrigeration unit, the second temperature sensor measures an instantaneous ambient temperature within the refrigeration unit;

a transmitter located within the refrigeration unit and operatively coupled to the first temperature sensor and the second temperature sensor, the transmitter periodically transmits the buffered temperature and the instantaneous ambient temperature from the temperature measuring device;

a receiver device receives the buffered temperature and the instantaneous ambient temperature, the receiver device is located outside of the refrigeration unit and the receiver device analyzes and records the buffered temperature and the instantaneous ambient temperature;

a rechargeable battery provides electrical power to the temperature measuring device;

means for wirelessly recharging the rechargeable battery; and a switching device that selectively provides the electrical power from the rechargeable battery to the transmitter for preserving energy in the rechargeable battery when not in use, the switching device controlled by a memory device.

2. The system for monitoring and reporting the internal refrigeration unit temperatures of claim 1, wherein the means for wirelessly recharging the rechargeable battery comprises a wireless charge receiver within the temperature measuring device, the wireless charge receiver receiving recharge power wirelessly from a wireless charge transmitter and the wireless charge receiver uses the recharge power to recharge the rechargeable battery.

3. The system for monitoring and reporting the internal refrigeration unit temperatures of claim 2, wherein the wireless charge receiver receives the recharge power wirelessly from the wireless charge transmitter by induction.

4. The system for monitoring and reporting the internal refrigeration unit temperatures of claim 3, wherein the memory device is controlled by a signal received by the wireless charge receiver that is sent from the wireless charge transmitter.

5. The system for monitoring and reporting the internal refrigeration unit temperatures of claim 1, wherein the memory device is a capacitor and the switching device is a field-effect transistor that is controlled by the capacitor.

6. The system for monitoring and reporting the internal refrigeration unit temperatures of claim 1, wherein the solid or liquid mass is propylene glycol.

7. A system for reporting internal refrigeration unit temperatures, the system comprising:

a first temperature sensor situated in a solid or liquid mass for measuring a buffered temperature in the solid or liquid mass within a refrigeration unit;

a second temperature sensor exposed to ambient air within the refrigeration unit, the second temperature sensor for measuring an instantaneous ambient temperature within the refrigeration unit;

a transmitter is operatively coupled to the first temperature sensor and to the second temperature sensor, the transmitter periodically transmits the buffered temperature and the instantaneous ambient temperature;

a rechargeable battery operatively coupled to the transmitter, the rechargeable battery provides electrical power to the transmitter;

a wireless charge receiver coupled to the rechargeable battery for receiving charge power wirelessly and providing electrical current to the rechargeable battery for recharging the rechargeable battery; and a switching device, the switching device controlled by a memory device and the switching device in series between the rechargeable battery and the transmitter such that in a first state of the memory device, the electrical power is provided to the transmitter and in a second state of the memory device, the electrical power is disconnected from the transmitter.

8. The system for reporting the internal refrigeration unit temperatures of claim 7, wherein the memory device is changed between the first state and the second state by the wireless charge receiver responsive to a wireless signal received by the wireless charge receiver.

9. The system for reporting the internal refrigeration unit temperatures of claim 8, wherein the wireless signal received by the wireless charge receiver comprises a modulation of inductive power from a wireless charge transmitter that is in proximity to the wireless charge receiver.

10. The system for reporting the internal refrigeration unit temperatures of claim 9, wherein the solid or liquid mass is selected from the group consisting of propylene glycol and glass beads.

* * * * *